United States Patent [19]

St. Mary

[11] 4,192,296

[45] Mar. 11, 1980

[54] MASSAGE MACHINE

[76] Inventor: Ronald J. St. Mary, P.O. Box 25574 Hawaii Kai, Honolulu, Hi. 96825

[21] Appl. No.: 895,540

[22] Filed: Apr. 12, 1978

[51] Int. Cl.[2] ..... A61H 7/00

[52] U.S. Cl. ..... 128/52; 128/57

[58] Field of Search ..... 128/51, 52, 57, 24.3, 128/33

[56] References Cited

U.S. PATENT DOCUMENTS

| | | | |
|---|---|---|---|
| 2,175,614 | 10/1939 | Redfield | 128/57 |
| 2,439,292 | 4/1948 | Golden | 128/243 |
| 2,446,098 | 7/1948 | Niblack | 128/57 |
| 3,083,709 | 4/1963 | Lengsfeld | 128/57 |
| 3,882,856 | 5/1975 | Heuser et al. | 128/57 |

*Primary Examiner*—Lawrence W. Trapp

[57] ABSTRACT

A lightweight portable massaging platform in which a plurality of free rolling rollers are mounted in a carriage which reciprocates along a stationary track. The rollers are journaled in bearings which serve to accommodate both the free turning of the rollers and the reciprocal motion of the carriage.

6 Claims, 4 Drawing Figures

MASSAGE MACHINE

The present invention relates to lightweight portable massaging platforms of the type wherein all or a substantial portion of the human anatomy is subjected to massaging through the action of reciprocating rollers.

Previously considerable difficulty had been experienced with massaging devices of a size sufficient to act on all or a substantial portion of the human anatomy at one time. Previous expedients included, for example, those shown in Redfield U.S. Pat. No. 2,175,614 wherein a heavy complicated structure is employed to effect the mounting of the rollers and reciprocation of the carriage to which the rollers are mounted; Golden U.S. Pat. No. 2,439,292 which likewise employs heavy complicated carriage and roller mounting structures; and Ackerman U.S. Pat. No. 2,461,102 which likewise employs a heavy complicated mechanism to actuate the rollers.

According to the present invention, there is provided a compact, lightweight structure which is highly efficient for its intended purpose. A stationary frame is provided with track members so as to receive and guide for reciprocal motion a carriage-roller assembly. The rollers are mounted generally transversely to the direction of reciprocal motion. The ends of the rollers are provided with axially extended axles which are journaled in bearings. A carriage is provided which serves to mount the rollers in the desired spaced apart relationship. The carriage also serves as a structure to which a reciprocating linkage is attached. The bearings in which the rollers are journaled are of the compound self-contained type wherein the axles of the rollers are received in the inner race and the outer race rests on the tracks which form part of the frame. Both the carriage and the rollers are supported by the self-same bearing. Because of the use of compound bearings, the outer race is capable of moving along a reciprocal path without imparting any rotary motion to the rollers. Likewise, the rollers can rotate independently of the outer races. Substantial savings in weight and expense as well as reductions in complexity are accomplished by using these bearings for a dual function.

The compact, efficient, and lightweight nature of this massaging platform permits it to be transported wherever desired and used without any complicated mounting structures. It serves to tone and relax the muscles and as an aid in weight reduction. The devices according to the present invention are useful for physical therapy and elsewhere where massaging is beneficial.

Figure 1:
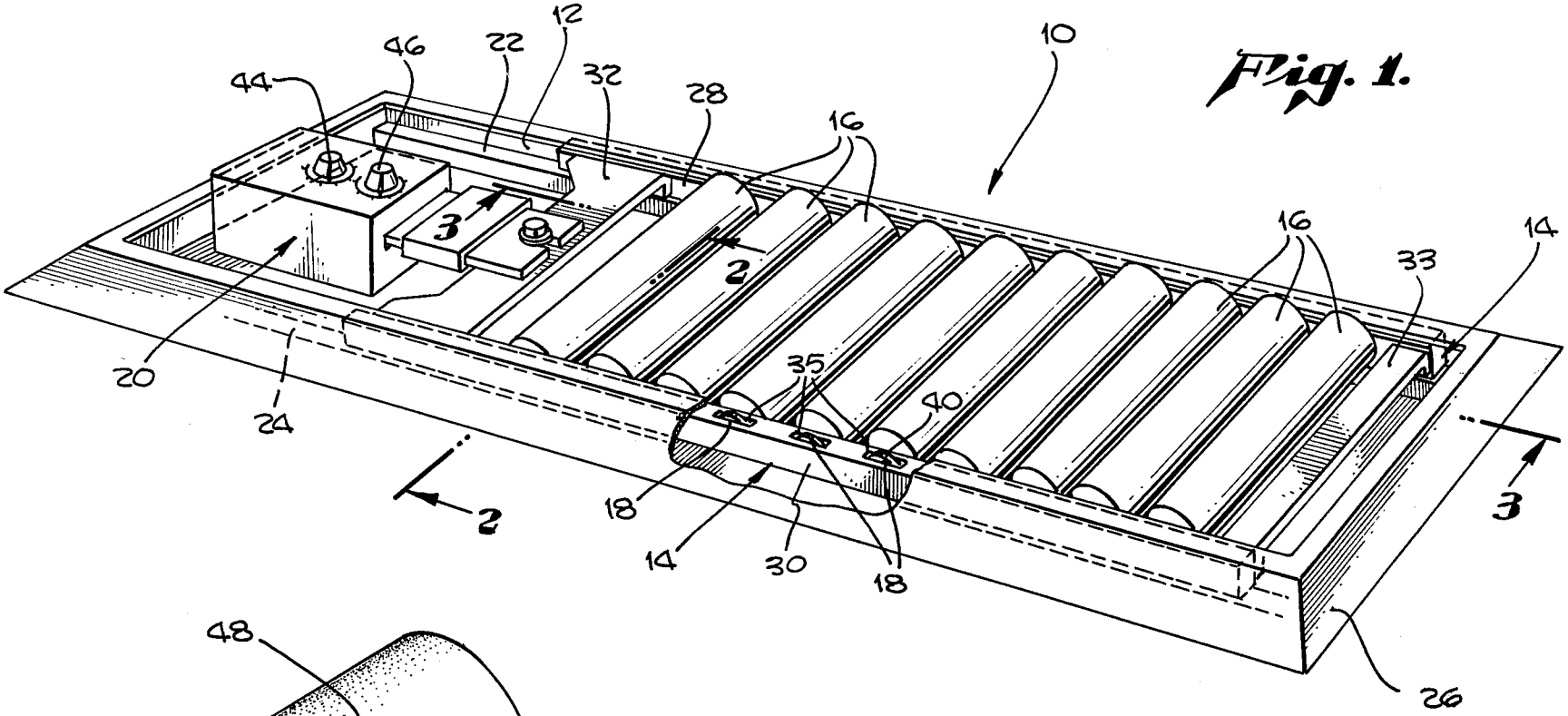
Figure 2:
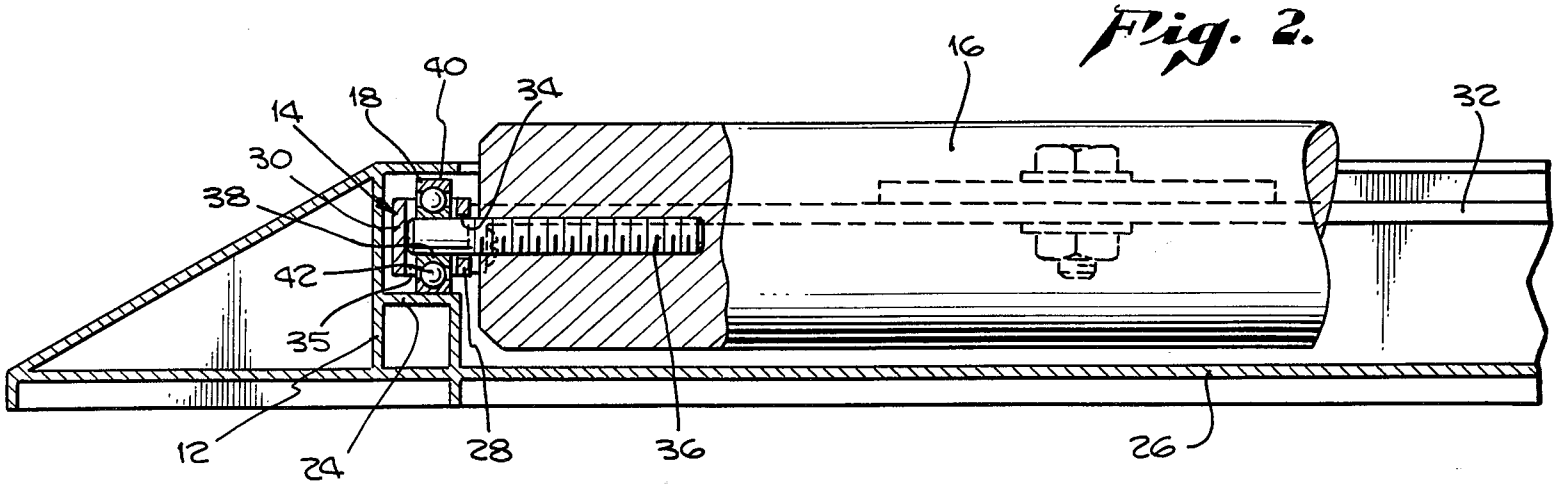
Figure 3:
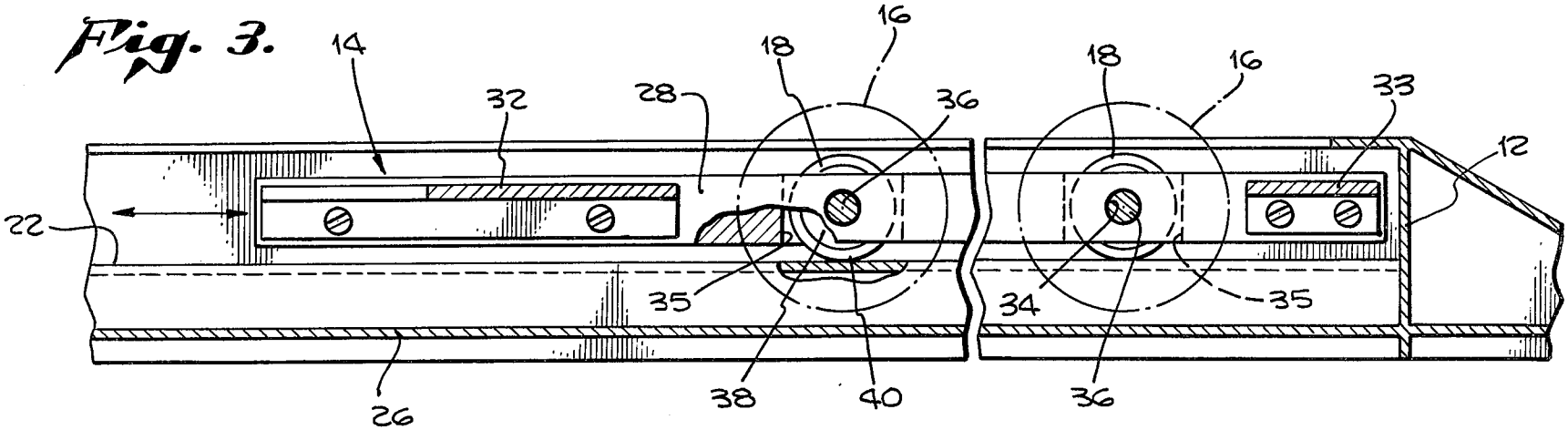

Referring particularly to the drawings, there is shown for the purpose of illustration only and not limitation:

FIG. 1, a perspective view of one embodiment of the massaging platform according to the present invention;

FIG. 2, a cross-sectional view taken along line 2—2 in FIG. 1;

FIG. 3, a cross-sectional view taken along line 3—3 in FIG. 1; and

Figure 4:
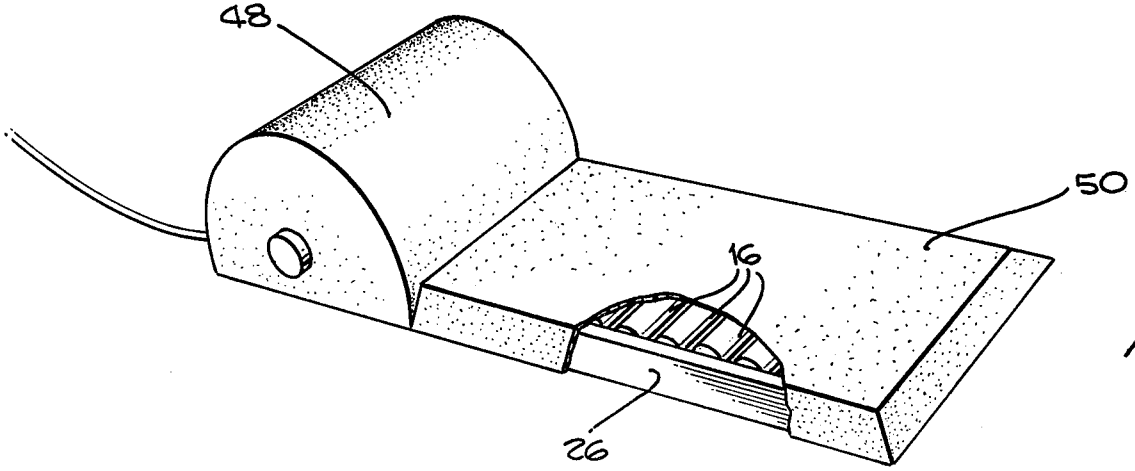

FIG. 4, a broken view showing a headrest and a flexible covering on the embodiment of FIG. 1.

Referring particularly to the drawings, there is illustrated generally at 10 a massaging platform which includes a stationary frame 12, a carriage 14 which is mounted for reciprocal movement relative to frame 12. Rollers 16 are mounted in carriage 14 on self-contained bearings 18. An electrical motor and reciprocating linkage indicated generally at 20 are operatively connected to carriage 14 for imparting reciprocal motion thereto.

Frame 12 includes a first track 22 and a second track 24. Rigidity is provided to frame 12 by base 26. First and second tracks 22 and 24, respectively, are disposed on the same side of base 26, spaced apart in parallel arrangement for receiving carriage 14 therebetween.

Carriage 14 is composed of an inner rail 28, which is integral with an outer rail 30, a plate 32, and a bracket 33. Inner rail 28 is provided with circular bores 34 through which the axially mounted shaft 36 of roller 16 pass. The coaction between the axially mounted shafts 36 and the circular bores 34 in inner rail 28 carry the carriage 14 and the rollers together when reciprocal motion is imparted to carriage 14 by element 20. The self-contained bearings 18 are confined in cavities 35 between the integral inner and outer rails 28 and 30, respectively.

The self-contained bearings 18 comprise an inner race 38, and outer race 40, and antifriction bearing elements 42. Axial mounting shafts 36 are fixed to and turn with inner race 38. Outer race 40 rests on the respective tracks 22 and 24. Rollers 16 are free to turn without regard to the movement of outer race 40 along the respective tracks. Outer race 40 may also roll along the respective tracks without causing roller 16 to rotate.

The electrical motor and reciprocating linkage 20 is of conventional design and is provided with conventional timer and speed controls indicated at 44 and 46, respectively.

As shown particularly in FIG. 4, a headrest indicated at 48 may be provided to cover the element 20 as well as to provide an elevated position for the head if such is desired. A flexible cover or sheet 50 may be provided to extend over the rollers so as to be positioned between the rollers and the person using the device. In this way the action of the rollers may be somewhat modified and also a cover may be desired for sanitary purposes.

As will be understood by those skilled in the art, what has been described are preferred embodiments in which modifications and changes may be made without departing from the spirit and scope of the accompanying claims.

What is claimed is:

1. In a lightweight, portable massaging platform: a rectangular frame member including track members extending longitudinally of said frame member, a moveable carriage member, a plurality of free rotating roller elements retained in transverse parallel arrangement by said carriage member and moveable therewith, means for reciprocating said carriage member in said frame member, the remote ends of said roller elements being journaled in self-contained bearings, said bearings being movably supported on said track members independently of the rotation of said roller elements, said carriage member being supported by said bearings for reciprocal motion in said frame member along said track members whereby said carriage member moves independently of the rotation of said roller elements.

2. In a lightweight, portable massaging platform of claim 1 means for controlling the rate at which carriage member reciprocates.

3. A lightweight, portable massaging platform of claim 1 wherein the means for reciprocating includes a timing member which inactivates said means for reciprocating after a predetermined period of operation.

4. A lightweight, portable massaging platform of claim 1 including a flexible covering over said rollers.

5. A lightweight, portable massaging platform of claim 1 including a headrest mounted on said frame member.

6. In a lightweight, portable massaging platform, a reciprocating roller carriage, a plurality of free rotating roller elements retained in a predetermined spaced relationship by said carriage, said roller elements being journaled in self-contained bearings, each of said bearings having an inner race and an outer race, said roller elements being mounted in said inner races, said outer races being supported for rolling movement on a stationary track means, and means for imparting reciprocal motion to said carriage, said carriage being supported by said roller elements whereby said bearings support both the carriage and the roller elements so that the roller elements rotate independently of the movement of the carriage.

* * * * *